US005149180A

United States Patent [19]

Haab et al.

[11] Patent Number: 5,149,180

[45] Date of Patent: Sep. 22, 1992

[54] ARTICLE OF FURNITURE WITH A DOOR SLIDABLE INTO DOOR COMPARTMENT

[76] Inventors: Karl Haab, Obere Weidstrasse 7, CH-6343 Rotkreuz, Switzerland; Otto Haab, Im Erspach, CH-8932 Mettmemstetten, Switzerland

[21] Appl. No.: 493,159

[22] Filed: Mar. 14, 1990

[30] Foreign Application Priority Data

Mar. 14, 1989 [CH] Switzerland ..... 943/89
Dec. 20, 1989 [CH] Switzerland ..... 4591/89

[51] Int. Cl.[5] ..... A47B 88/00

[52] U.S. Cl. ..... 312/322; 49/254; 312/331; 312/332

[58] Field of Search ..... 312/109, 110, 331, 332, 312/334, 322; 49/254

[56] References Cited

U.S. PATENT DOCUMENTS 962,228 6/1910 Kuersten ..... 49/257
972,412 10/1910 Taussig ..... 49/257
4,821,375 4/1989 Kozon ..... 312/110
4,945,972 8/1990 Takeuchi ..... 49/257

FOREIGN PATENT DOCUMENTS 0254041 6/1987 European Pat. Off. .
933584 10/1951 Fed. Rep. of Germany .
2045763 6/1972 Fed. Rep. of Germany .
2405669 10/1978 France .

*Primary Examiner*—Gerald A. Anderson
*Attorney, Agent, or Firm*—Egli International

[57] ABSTRACT

A door for an article of furniture which is slidable into a door compartment is fastened to a door-carrying bar which in turn is connected to a scissors-assembly having two beams anchored on one side wall of the door compartment. The door-carrying bar is guided on an upper rail fixed to one of two side walls of a door compartment and on a lower rail also disposed in the door compartment. In order to permit a precise fitting of the door and to facilitate an adjustment of the door, the lower rail is also fixed to the one of two side walls. Both rails are connected to the one side wall by bushings screwed into the rails and permitting an adjustment of a spacing of the rail from the side wall. The door-carrying bar has a roller which, when the door is not lowered, presses against a plastic plate provided in the vicinity of the leading edge of the one side wall. A setscrew is provided to permit a vertical displacement of the bar with respect to the scissors-assembly.

33 Claims, 5 Drawing Sheets

FIG. 2a
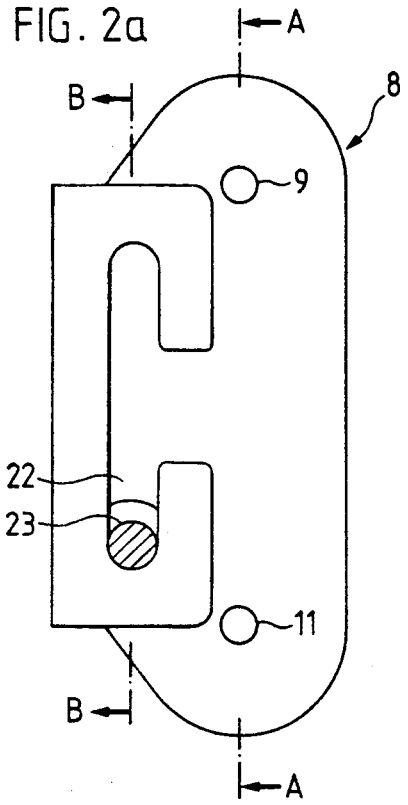
FIG. 2b
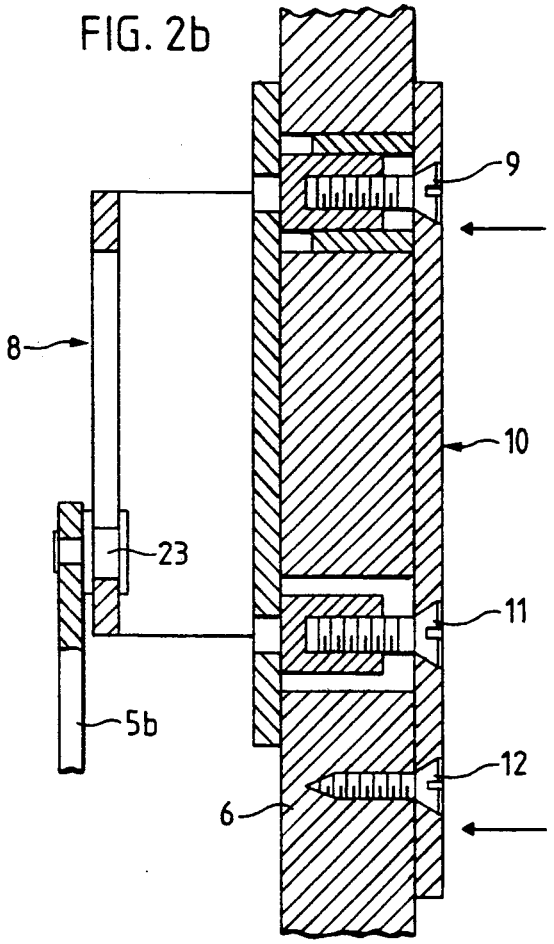
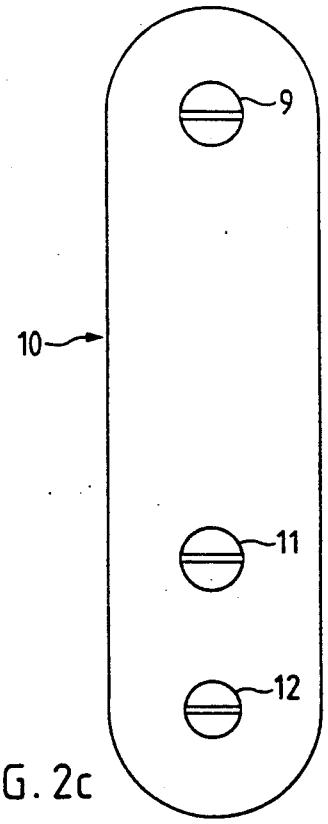
FIG. 2c
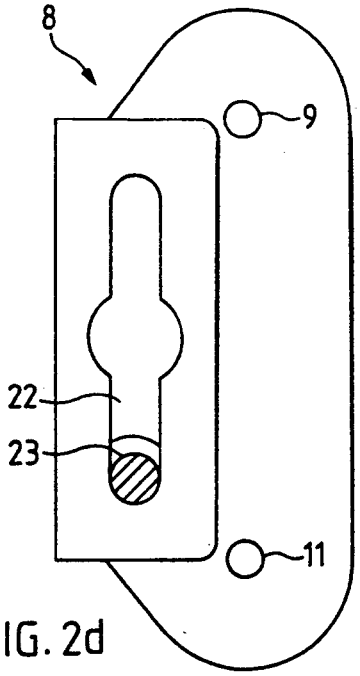
FIG. 2d

ARTICLE OF FURNITURE WITH A DOOR SLIDABLE INTO DOOR COMPARTMENT

BACKGROUND OF THE INVENTION

The present invention relates to a furniture article and a door therefor, which can be moved from an upward use position down into a door compartment having at least one side wall. The assembly of the type under consideration includes a door carrying vertical bar, to which the door is connected, and a scissors assembly. The door carrying bar is guided at its upper end on an upper rail fixed to the side wall and also on a lower rail at its lower end. The beams of the scissors assembly are connected to the one side wall of the door compartment and to the door-carrying bar in each case by two respective anchor arrangements, one of which is fixed and the other is vertically displaceable.

Such a piece of furniture is known from U.S. Pat. No. 972,412. Experience has shown that in the case of the lowerable or slidable doors as described in the aforementioned specification, particularly when the door is subsequently fitted, as is nowadays conventionally the case, even when great care is taken during the fitting of the door, problems occur linked with minor changes in the geometry of the retaining or holding device, such as result from loading by various forces and moments applied to the door.

EP-A1-254041 discloses another furniture article of the foregoing type. This very practical solution offers the possibility of subsequently adjusting various parameters of the article of furniture. In particular, it is possible to laterally displace the guide rails, which are fitted to the top and bottom of the door compartment in this known arrangement, which permits an adjustment reliably preventing any jamming of the scissors-type connection. However, the adjustment can only take place following the assembly of the door compartment and requires manipulations in the interior thereof.

SUMMARY OF THE INVENTION

It is an object of the present invention to provide a furniture door, which can be flexibly used and is robust and, if necessary, can be adapted to given requirements with limited expenditure. In particular, the guidance of the door-carrying bar must be reliable and satisfy the requirement for a construction facilitating subsequent adjustment. According to the invention, the lower rail as well as the upper rail are fixed to one and the same side wall of the door compartment. This is particularly significant, because only one side wall of the door compartment with the retaining mechanism anchored thereto can be supplied and the actual fitting of the door into the furniture article can take place at a later date.

The advantages obtained from the invention are in particular that the furniture article according to the invention is very suitable for later assembly with subsequent adjustment. The one side wall with the retaining mechanism can be easily connected to the parts, which are possibly supplied by other manufacturers, such as the top, bottom and the other side wall of the door compartment, as well as the actual door and so as to permit the necessary adaptations. The retaining device including two guide rails can be mounted in a ready-to-install manner in the factory which ensures a more accurate installation than in the case of subsequent fitting of the guide rail during the assembly of the article of furniture. This provides a great robustness of the retaining device.

Additionally, it is possible to construct the guide rails in an adjustable manner. Due to the invention and its easy adaptation to use conditions, jamming of the scissors assembly is reliably prevented.

Due to the present invention, hanging of the door outwardly of the door compartment, which can easily occur, especially when the door is fastened subsequently, can be corrected, without tiresome and annoying dismantling and manipulations in the door compartment which are typically necessary.

The aforementioned objects, features and advantages of the invention will, in part, be pointed out with particularity, and will, in part, become obvious from the following more detailed description of the invention, taken in conjunction with the accompanying drawing, which form an integral part thereof.

BRIEF DESCRIPTION OF THE DRAWINGS

FIG. 2*a* is an enlarged front view of an upper anchor arrangement of a scissors-assembly on the first side wall in the left-hand upper corner of FIG. 1, with one scissors-assembly beam omitted;

FIG. 2*b* is a sectional view taken along line A—A and in part along line B—B of FIG. 2*a;*

FIG. 2*c* is a plan view of a detail of FIG. 2*b* taken in the direction indicated by arrows;

FIG 2*d* is a front view of a further embodiment of the upper anchor arrangement of the scissors-assembly on the first side wall, corresponding to FIG. 2*a;*

DETAILED DESCRIPTION OF THE PREFERRED EMBODIMENTS

Figure 1:
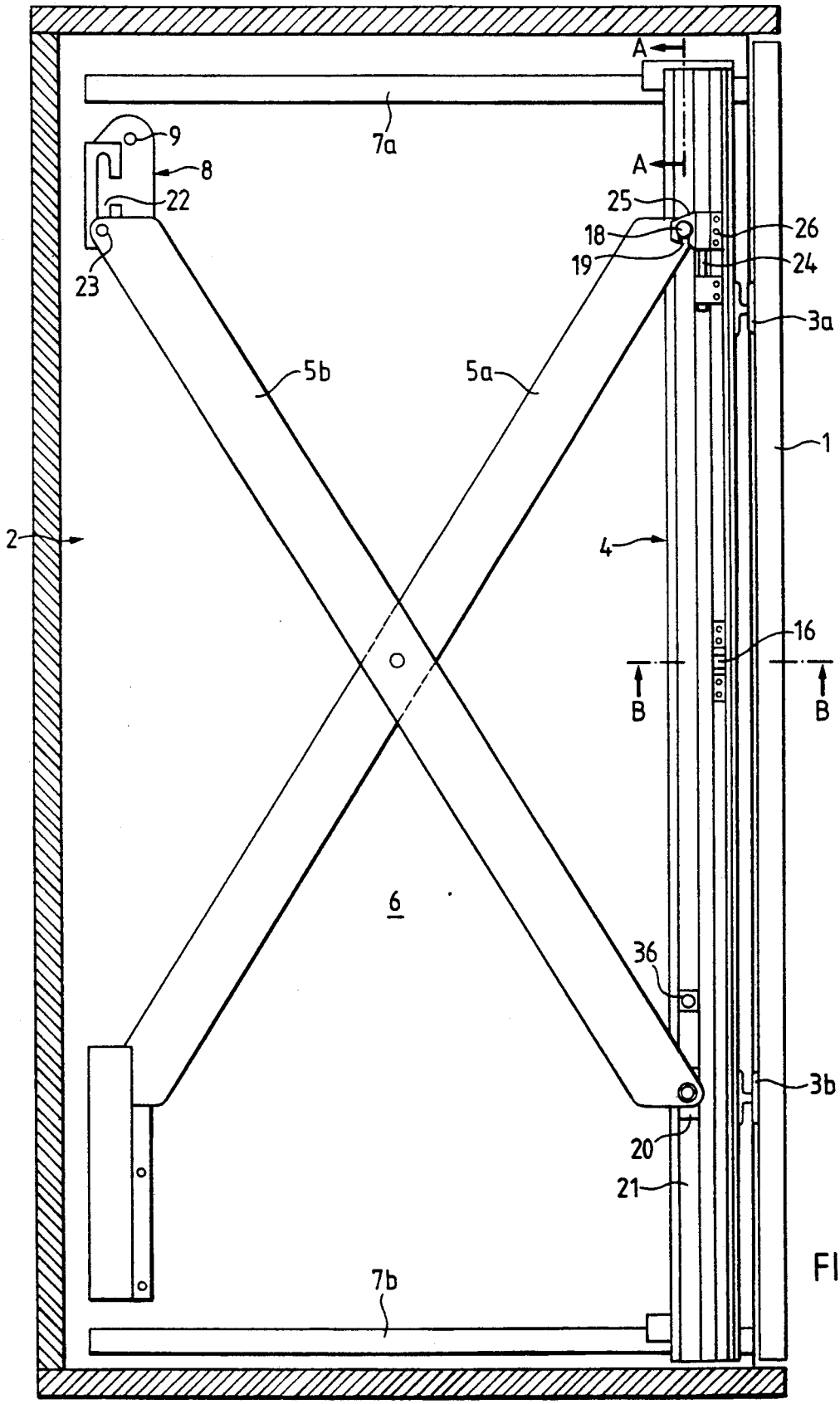
FIG. 1 is a front view of a door panel according to the invention, with only one of two side walls shown.

Referring now to the drawings, they show a furniture article with a door 1 which is slidable or lowerable into a door compartment 2. The door 1 is fastened by means of cup hinges 3*a*, 3*b* to a door-carrying bar 4, which is carried by a scissors-assembly or arrangement having two beams 5*a*, 5*b* which are connected with the bar by two anchor arrangements, of which the top anchor arrangement is fixed and the bottom anchor arrangement is vertically displaceable. The fixed and displaceable anchor arrangements also connect beams 5*a*, 5*b* to a first side wall 6 of the door compartment 2. It is naturally also possible for the upper anchor arrangement to be displaceable and the lower anchor to be fixed. However, the preferred arrangement has the advantage that the effect of the weight of the scissors assembly assists the lowering of door 1 and, prior to the fastening thereof, ensures that the scissors assembly remains lowered in the door compartment 2. FIG. 1 shows the article of furniture with an unlowered, closed door 1, the scissors-assembly being open. Door 1 and bar 4 are located in the use position. If the door 1 is completely open, it can be slid or lowered into the door compartment 2, with the scissors-assembly 5*a*, 5*b* collapsing and the bar 4, guided on an upper rail 7*a* and a lower rail 7*b*, being slid to the rear end of the door compartment 2.

The upper rail 7*a* and the lower rail 7*b* serve to precisely guide the door-carrying bar 4 and consequently prevent a twisting and jamming of the scissors assembly 5*a*, 5*b*.

Figure 3:
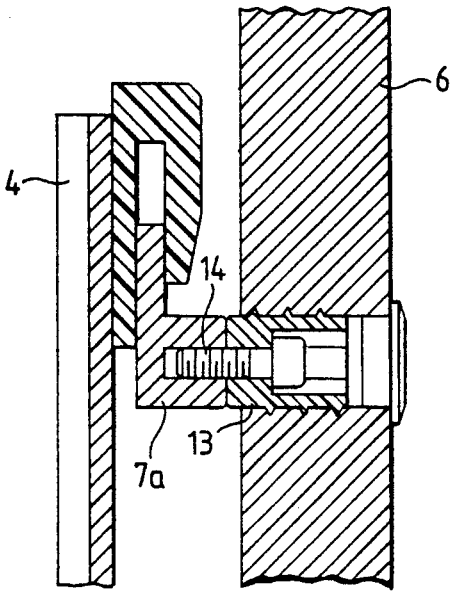
FIG. 3 is a sectional view taken along line A—A in FIG. 1, on enlarged scale.

According to the invention, not only the upper rail 7*a*, but also the lower rail 7*b* is mounted on the first side wall 6. This has the advantage that a first adjustment of the rails can take place during the fitting of the retaining device, e.g. rails by the manufacturer, as opposed to taking place at the time of assembling the door compartment 2. If a readjustment after the assembly should be necessary, the rails 7*a*, 7*b* are fixed to the side wall 6 in such a fashion that their spacing from wall 6 can be adjusted from the side of the first side wall 6 opposite to the door compartment. As seen from FIG. 3, the rails 7*a*, 7*b* are fixed to the side wall 6 by sleeves or bushings 13 having an external thread and screwed to the respective rail, e.g. the upper rail 7*a* by screws 14. If it is necessary to modify the spacing between rail 7*a* and side wall 6, the screw 14 which is in engagement through the end of bushing 13 with the rail 7*a* is loosened, the bushing 13 is moved by turning, using e.g. a hexagon socket wrench, and then screw 14 is tightened again. This permits re-adjustment of the rail without tiresome manipulations within the door compartment 2, which saves a considerable amount of extra work. The underside of the bar 4 is provided with an engaging guide which engages an upwardly extending projection of rail 7*a* to slide along the latter as shown in FIG. 3.

Figure 6A:
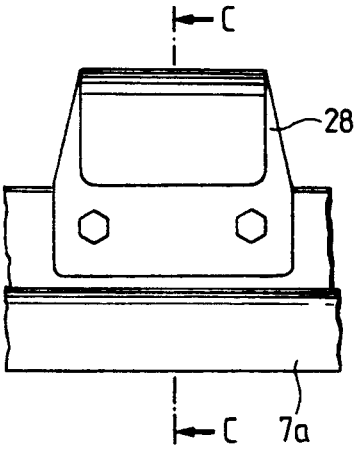
FIG. 6*a* is a side view of an upper rail of, a further embodiment, with a guide plate for guiding the (not illustrated) door, on lowering it into the door compartment.
Figure 6B:
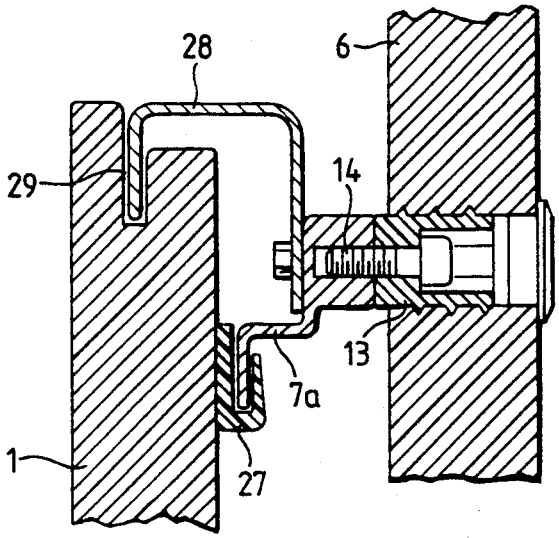
FIG. 6*b* is a sectional view taken along line C—C in FIG. 6*a*, with the door also shown.

An alternative construction of rail 7*a* shown in FIGS. 6*a*, 6*b* facilitates the guidance of the bar by a guidance of door 1, which is produced by a guide member 27, which engages with rail 7*a* on lowering the door into the compartment. Thus, uncontrolled lateral movements of the door are reliably prevented. Another possibility of guiding door 1 is provided by a guide plate 28, which engages in a slot 29 formed in the top of door 1. Both alternative possibilities are shown in FIG. 6*b*. They can be readily combined, but one of them is normally sufficient and adequate. Identical guides can be provided at the lower end of door 1.

Figure 7:
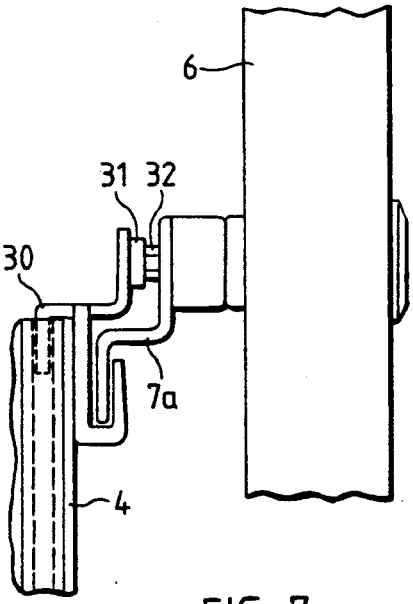
FIG. 7 is a side view of the door-carrying bar of an alternative embodiment and its guidance on the upper rail.

FIG. 7 shows a further alternative embodiment of the guidance of the door-carrying bar 4 suitable for the above-described construction of rail 7*a*. The bar 4 carries a strut-like guide 30 partially inserted therein. Guide 30 has a U-shaped part which is in engagement with rail 7*a*, and also carries a snap device 31 which, together with a screw 32 mounted on rail 7*a*, forms a snap lock effective against an undesired sliding of the bar 4 back out of the use position into the door compartment 2. Due to the fact that this snap lock acts between the door-carrying bar 4 and the rail 7*a*, it does not have to be adjusted on modifying the spacing of rail 7*a* from the first side wall 6. Although a guide plate for guiding the door, as shown in FIG. 6*a*, 6*b* is not shown here, it can easily be provided.

The fixed anchor arrangement of beam 5*b* on the first side wall 6 includes a fixing member 8 (FIG. 1, 2*a*, 2*b*, 2*c*, 2*d*), which is connected through the wall by means of a screw connection 9 to an adjusting member 10 (FIG. 2*b*) in such a way that the screw connection 9 forms a common fulcrum for fixing member 8 and adjusting member 10. In addition, the fixing member 8 and the adjusting member 10 are connected to each other by a further screw connection 11, which passes through the first side wall 6 with a lateral or peripheral clearance, so that with the screw connection 11 loosened, the fixing and adjusting members 8, 10 can be jointly pivoted about their common fulcrum. However, if after the fastening of the door 1, it is found that it hangs out to a certain extent then the screw connection 11 is loosened and the lower end of adjusting member 10 is pressed rearwards. The fixing member 8 is carried therealong and, consequently, the upper anchoring point of the scissors-assembly is rearwardly displaced. As a result the door-carrying bar 4 and door 1 are aligned. When the adjustment is completed the screw connection 11 is tightened and forms a clamping connection between the fixing member 8 and the adjusting member 10, on the one hand, and the first side wall 6, on the other hand. In addition, the adjusting member 10 is secured against pivoting about the fulcrum by a screw 12. Thus, the adjustment can be easily performed from outside the door compartment 2 with the retaining mechanism and the fastened door 1 completely assembled.

Figure 8A:
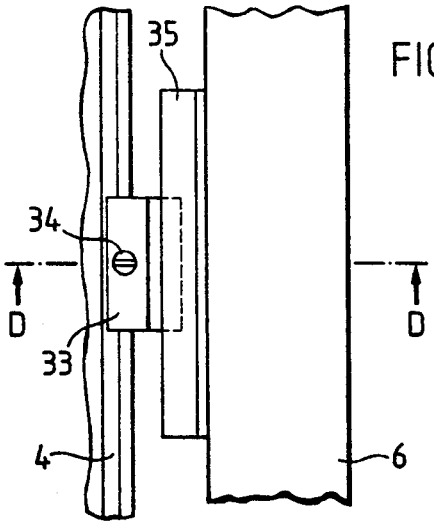
FIG. 8*a* shows a stop for preventing the drawing of the bar shown in FIG. 7 out of the door compartment, in a sectional view.
Figure 8B:
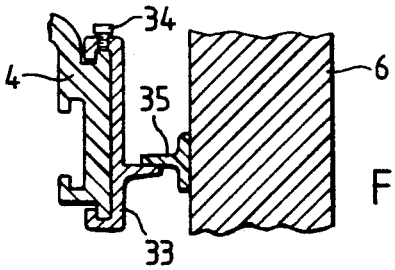
FIG. 8*b* is a sectional view taken along line D—D in FIG. 8*a*.

A stop member 33 (FIGS. 8*a*, 8*b*) fixed by means of a clamping screw 34 to door-carrying bar 4 prevents the latter from being drawn out of the door compartment 2 beyond the use position. It cooperates with a stop element 35 fixed to the first side wall 6. On loosening the clamping screw 34, the stop member 33 can be slid along the bar 4 out of the area in which it cooperates with the stop element 35 or slips automatically out of said area under the influence of gravity. The door-carrying bar 4 can then be drawn out of the door compartment 2 for adjustment or other maintenance purposes. For securing the bar 4 in this position, it is possible to provide another snap lock (not illustrated) between the door compartment 2 and bar 4, so that the latter does not slide back into the compartment 2.

Figure 4:
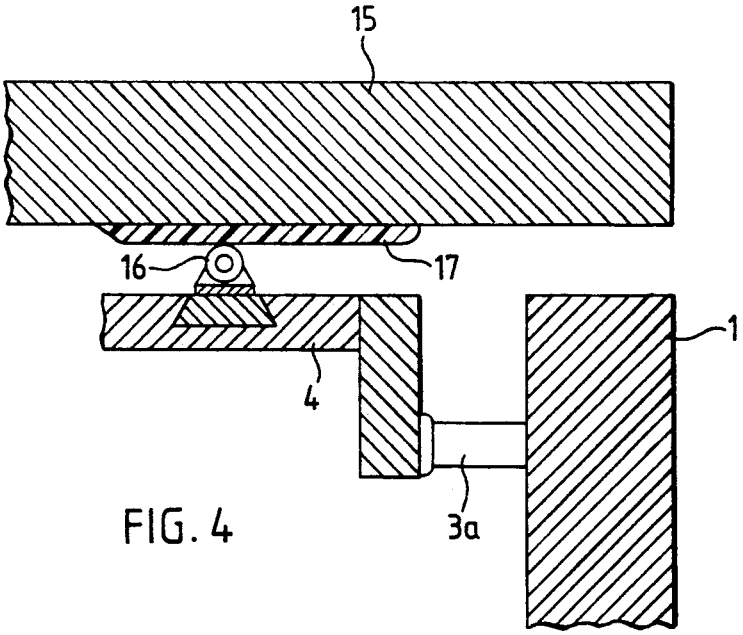
FIG. 4 is a sectional view taken along line B—B in FIG. 1, on enlarged scale.

Normally the door compartment 2 is limited on the side opposite to the first side wall 6 by a second side wall 15 shown in FIG. 4. If the distance between the second side wall 15 and the first side wall 6 is too great, then a disturbing gap occurs, whereas if it is too small the edge of door 1 rubs against the second side wall 15 during opening and closing, which can lead to considerable damage to the door 1, e.g. splintering of the veneer. Thus, a roller 16 is fixed to the door-carrying bar 4 which roller can be displaced along a dovetail groove of bar 4 and can be fixed to the bar 4 by means of screws. The roller 16 is spaced from the second side wall 15, so that annoying noise is avoided during the insertion or drawing out of the door 1. When door 1 is drawn out, the roller 16 presses against a plastic plate 17 fitted to the second side wall 15 in the vicinity of the front edge thereof. Plate 17 ensures an adequate spacing between the side wall 15 and door 1, even if the spacing is actually too small. In order to increase a tolerance range, it is also possible to provide a mounting support for roller 16, which would make it possible to modify its distance from the door-carrying bar 4.

Figure 9:
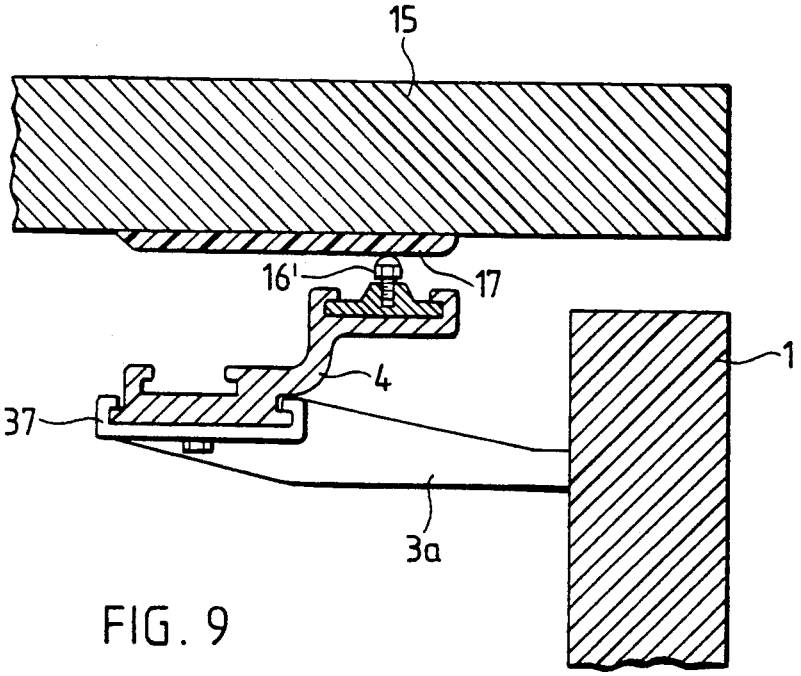
FIG. 9 is a sectional view similar to that of FIG. 4, with the door-carrying bar of FIG. 7, and illustrating the fastening of the door to the bar.

In an alternative construction shown in FIG. 9, roller 16 is replaced by a screw 16', which has a rounded head abutting against plate 17 and which facilitates the adaptation to the spacing with respect to the second side wall 15. FIG. 9 further shows an alternative construction of the door-carrying bar 4, in which hinges 3*a* and 3*b* (FIG. 1) are provided having an identical construction. Each hinge is fixed to the bar 4 by means of a retaining part 37, which embraces a protruding part of the bar 4 in a claw-like manner. This construction saves space compared with that of FIGS. 1 and 4.

Figure 5:
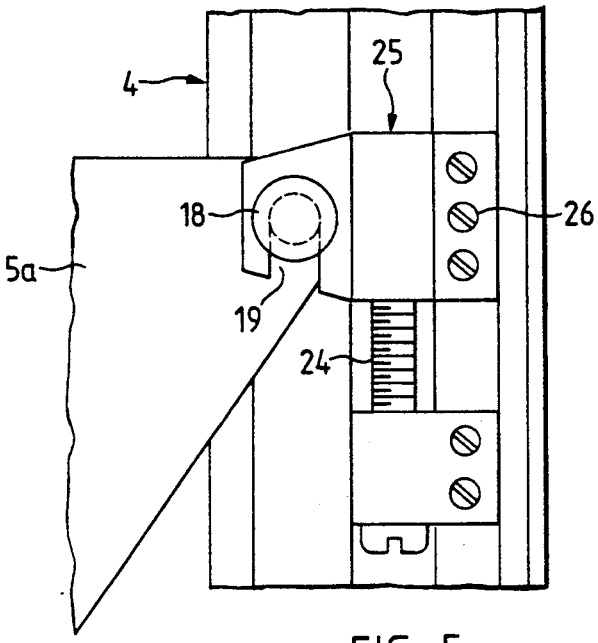
FIG. 5 is a larger-scale view of an upper anchor arrangement of the scissors-assembly on a bar carrying the door in the right-hand upper corner of FIG. 1.

The anchoring of the scissors-assembly (FIGS. 1, 5) to the door-carrying bar 4 is provided by the upper fixed anchor arrangement of beam 5*a*, which is formed by a bolt 18 anchored to the beam 5*a* and a slot 19 which is open downwardly or may be widened as in FIG. 2*d*. Slot 19 is formed in a carrier element 25 fixed to the bar 4. A vertically displaceable plastic slide 20 (FIG. 1) is connected in a rotary manner to the beam 5*b* and is guided in a downwardly open dovetail-shaped groove 21 in the bar 4. Since after moving the stop member 33 out of the vicinity of the stop element 35, the bar 4 can be completely drawn out of the door compartment 2, it can be equally easily detached from the scissors assembly 5*a*, 5*b*.

In the same way the anchoring arrangement for the beam 5*b* of the scissors assembly on the top of the first side wall 6 is formed by an upwardly open or widened slot 22 (the first variant permitting easier assembly and disassembly, whilst the latter is mechanically more stable) provided in the fixing member 8 and a bolt 23 (FIG. 1) fixed to the beam 5*b*. At the bottom of the beam 5*a*, for anchoring of the scissors assembly system to the bar 4, a further slide member is connected in a rotary manner to the beam 5*a* , which is guided in an upwardly open dovetail-shaped groove, which in this case is terminated at its lower end by a sound reducing plastic stop, which permits the easy unhinging of the scissors assembly.

To ensure that an excessive drawing of the bar 4 out of the door compartment 2 does not lead to the unintentional drawing of the beam 5*a* out of the displaceable anchor arrangement on the first side wall 6, a stop 36 (FIG. 1) is fitted to the bar 4, which limits the upward movement of slide 20 in the dovetail-shaped groove 21. Stop 36 is fixed in detachable manner, e.g. by means of a clamping screw, which facilitates an intentional unhinging of the scissors assembly 5*a*, 5*b*, as described hereinbefore.

To ensure that the scissors assembly takes up a minimum amount of depth of the door compartment 2 with door 1 lowered, the anchor arrangements of the scissors assembly on door-carrying bar 4 and on the first side wall 6 are fitted to the outer corners of beams 5*a*, 5*b*, respectively.

The many possible adjustments are supplemented by a set or adjusting screw 24, which makes it possible to vertically displace door-carrying bar 4 with respect to the support or carrier element 25 suspended on bolt 18 by means of slot 19. It is merely necessary to loosen screws 26, which secure the carrier element 25 against a vertical displacement of bar 4, adjust the position of the bar 4 by turning the set screw 24 and then re-tightening screws 26. As described hereinbefore, for the purpose of this adjustment, the door-carrying bar 4 can naturally be drawn out of the door compartment 2, which makes work much easier.

There has been disclosed heretofore the best embodiment of the invention presently contemplated. However, it is to be understood that various changes and modifications may be made thereto without departing from the spirit of the invention.

What is claimed is:

1. A furniture article in combination with a door slidable from a use position into a door compartment of the furniture article, said door compartment having at least one side wall, the combination comprising:

a door;

a substantially vertical door-carrying bar coupled to said door;

opposite guide rails provided in said compartment each having means for slidably engaging said door-carrying bar for guiding said bar with said door into or out of said compartment;

a scissors-assembly positioned in said compartment and having two beams connected to said one side wall by two first anchor means and to said bar by two said second anchor means, one of said two first anchor means and one of said two second anchor means being fixed, and the other one of said two first anchor means and the other one of said two second anchor means being vertically displaceable;

said rails including an upper rail for guiding an upper end of said bar and a lower rail for guiding a lower end of said bar, said upper rail and said lower rail both being fixed to said one side wall; and fixing means by which said rails are fixed to said side wall, said fixing means including means for permitting adjustment of spacing of a respective rail from said one side wall from a side thereof opposite said door compartment.

2. A furniture article in combination with a door slidable from a use position into a door compartment of the furniture article, said door compartment having at least one side wall, the combination comprising:

a door;

a substantially vertical door-carrying bar coupled to said door;

opposite guide rails provided in said compartment each having means for slidably engaging said door-carrying bar for guiding said bar with said door into or out of said compartment;

a scissors-assembly positioned in said compartment and having two beams connected to said one side wall by two first anchor means and to said bar by two second anchor means, one of said two first anchor means and one of said two second anchor means being fixed, and the other one of said two first anchor means and the other one of said two second anchor means being vertically displaceable;

said rails including an upper rail for guiding an upper end of said bar and a lower rail for guiding a lower end of said bar, said upper rail and said lower rail both being fixed to said one side wall; and fixing means by which said rails are fixed to said side wall, said fixing means permitting adjustment of spacing of a respective rail from one side wall from a side thereof opposite said door compartment;

wherein said fixing means include bushings anchored in said one side wall and moved inwardly or outwardly by turning clockwise or counterclockwise respectively.

3. The combination according to claim 2, wherein each of said bushings has an external thread and a screw therein for affixing the same to one of said rails.

4. The combination according to claim 1, wherein said door has at least one guide part engaging with one of said rails on said door.

5. The combination according to claim 1, further including at least one guide plate provided in the vicinity of an opening in said door compartment, said guide plate, on the door, engaging in a groove formed in the door.

6. The combination according to claim 5, wherein said groove is formed in the top of said door.

7. The combination according to claim 5, wherein said groove is formed in the bottom of said door.

8. The combination according to claim 5, wherein said at least one guide plate is fixed to one of said rails.

9. The combination according to claim 1, further comprising a snap lock provided between said bar and said compartment for preventing a movement of said bar from the use position into said door compartment when required.

10. The combination according to claim 9, wherein said snap lock is arranged to act between said bar and at least one of said rails.

11. The combination according to claim 1, wherein at least one anchor means connecting said scissors-assembly to said one side wall includes a fixing member and an adjusting member, said fixing member being connected to said adjusting member located on an opposite side of said one side wall so that by moving said adjusting member, said fixing member is displaceable at least horizontally along said one side wall.

12. The combination according to claim 11, wherein said fixed anchor means is connected to the adjusting member.

13. The combination according to claim 11, wherein said fixing member and said adjusting member are pivotable about a common fulcrum, to which they are connected through said one side wall.

14. The combination according to claim 13, wherein said fixing member and said adjusting member are connected to each other by means passing with a lateral clearance through an opening in said one side wall below said common fulcrum, so that pivoting movements about said fulcrum are possible.

15. The combination according to claim 14, wherein said means to connect said fixing member and said adjusting member to each other includes a screw connection having a screw operable from a side of said one side wall opposite to said door compartment and which simultaneously forms a loosenable clamping connection between said fixing member and said adjusting member and also between said fixing member and said one side wall.

16. The combination according to claim 13, wherein said adjusting member is fixed to said one side wall by a screw against pivoting about said fulcrum.

17. The combination according to claim 1, further comprising a stop member connected to said bar in such a way that, following the release of a fixture provided thereon, said stop member is displaceable over a certain position range along said bar, and a stop element fixed to said one side wall and cooperating with said stop member, when it is located in a specific portion of said position range, so that a removal of said bar from said door compartment is blocked.

18. The combination according to claim 1, wherein said door compartment includes another side wall facing said one side wall; and further comprising at least one spacer fitted to said bar and facing and spaced from said another side wall, and at least one plate provided, in the area of said another side wall adjacent to its leading edge and with which said spacer is in contact when said door is not lowered into said compartment.

19. The combination according to claim 18, wherein said spacer is displaceable along said bar after releasing a fixture provided thereon.

20. Combination according to claim 19, wherein said spaced is constructed as a roller.

21. The combination according to claim 19, wherein said spacer is constructed as a screw.

22. The combination according to claim 18, wherein said spacer is constructed as a roller.

23. The combination according to claim 18, wherein said spacer is constructed as a screw.

24. The combination according to claim 1, further comprising hinges provided on said door and fixed to said door-carrying bar by a claw-like retaining member embracing at least part of said bar.

25. The combination according to claim 1, wherein one of said fixed anchor means connecting said scissors-assembly to said door-carrying bar includes a bolt anchored to one of said beams of said scissors assembly and a support element having a slot and fixed to said bar, and said vertically displaceable anchor means including a slide connected in a rotary manner to another of said beams and guided in a dovetail-shaped groove open at at least one end, so that said door-carrying bar can be unhinged.

26. The combination according to claim 25, wherein another of said fixed anchor means connecting said scissors-assembly to said one side wall includes a fixing member having a slot and a bolt engaging in said slot and anchored to another of said beams of said scissors-assembly, and another vertically displaceable anchor means including a slide connected in a rotary manner to said one beam of said scissors-assembly and guided in an upwardly open dovetail-shaped groove, so that said scissors assembly can be unhinged.

27. The combination according to claim 26, wherein said slot has a widened portion.

28. The combination according to claim 25, wherein said slot is open downwardly.

29. The combination according to claim 1, wherein the displacement of said displaceable anchor means of said scissors-assembly on said door-carrying bar is upwardly limited by a stop detachably fixed to said bar against displacement along the same.

30. The combination according to claim 29, wherein said stop is fixed in a position, which allows a drawing of said door-carrying bar out of said door compartment but prevents a release of said scissors-assembly from the displaceable anchor means on said one side wall.

31. The combination according to claim 1, wherein said anchor means are provided at outer corners of said beams of said scissors-assembly.

32. The combination according to claim 1, wherein a part of said door-carrying bar is vertically displaceable with respect to said scissors-assembly.

33. A furniture article in combination with a door slidable from a use position into a door compartment of the furniture article, said door compartment having at least one side wall, the combination comprising:

a substantially vertical door-carrying bar connected to said door;

opposite guide rails provided in said compartment for guiding said bar with said door into or out of said compartment;

a scissors-assembly positioned in said compartment and having two beams connected to said one side wall by two first anchor means and to said bar by two second anchor means, one of said two first anchor means and one of said two second anchor means being fixed and another of said two first anchor means and another of two second anchor means being vertically displaceable;

said rails including an upper rail for guiding an upper end of said bar and a lower rail for guiding a lower end of said bar, said upper rail and said lower rail being fixed to said one side wall; and fixing means by which said rails are fixed to said side wall, said fixing means including means for permitting adjustment spacing of a respective rail from said one side wall from a side thereof opposite said door compartment.

* * * * *